US007716854B2

(12) United States Patent
Roux et al.

(10) Patent No.: US 7,716,854 B2
(45) Date of Patent: May 18, 2010

(54) TWO-LAYER SPORTS BOOT PART WITH DEFORMATION ZONE

(75) Inventors: Pascal Roux, Saint Egreve (FR); Riccardo Perotto, Venegazzu (IT); Maurizio Botter, Montebelluna (IT)

(73) Assignee: Lange International S.A., Fribourg (CH)

( * ) Notice: Subject to any disclaimer, the term of this patent is extended or adjusted under 35 U.S.C. 154(b) by 482 days.

(21) Appl. No.: 11/338,530

(22) Filed: Jan. 24, 2006

(65) Prior Publication Data

US 2006/0162192 A1 Jul. 27, 2006

(30) Foreign Application Priority Data

Jan. 26, 2005 (EP) ..... 05425031

(51) Int. Cl.
*A43B 5/04* (2006.01)

(52) U.S. Cl. ..... 36/50.5; 36/118.2

(58) Field of Classification Search ..... 36/50.1, 36/117.1–119.1, 50.5
See application file for complete search history.

(56) References Cited

U.S. PATENT DOCUMENTS 4,372,061 A * 2/1983 Pozzobon ..... 36/119.1
5,397,141 A 3/1995 Hoshizaki et al.
5,765,299 A * 6/1998 Hayashi et al. ..... 36/117.1
5,806,212 A * 9/1998 Benoit et al. ..... 36/118.9
5,924,706 A 7/1999 Seltzer et al.
5,926,979 A * 7/1999 Borel ..... 36/115
6,009,639 A * 1/2000 Donnadieu et al. ..... 36/118.2
6,467,195 B2 * 10/2002 Pierre et al. ..... 36/50.5
2004/0103562 A1 * 6/2004 Chaigne ..... 36/117.1

FOREIGN PATENT DOCUMENTS

| | | |
|---|---|---|
| EP | 0 484 845 A | 5/1992 |
| EP | 0 659 358 A | 6/1995 |
| EP | 0 948 911 A | 10/1999 |
| FR | 2 119 653 A | 8/1972 |
| WO | WO 03/001937 A | 1/2003 |

* cited by examiner

*Primary Examiner*—Ted Kavanaugh
(74) *Attorney, Agent, or Firm*—Frommer Lawrence & Haug LLP; Ronald R. Santucci

(57) ABSTRACT

A sports boot comprising a part comprising at least two superposed layers of plastics and comprising an opening that can be closed by catching means distributed on either side of this opening, wherein one of the two layers has one or more recesses lying on an axis in order to define a deformation axis of the shell, allowing that part of the shell that is around this axis to move away in order to enlarge the opening and make it easier to put the boot on and to take it off.

16 Claims, 3 Drawing Sheets

Fig.3
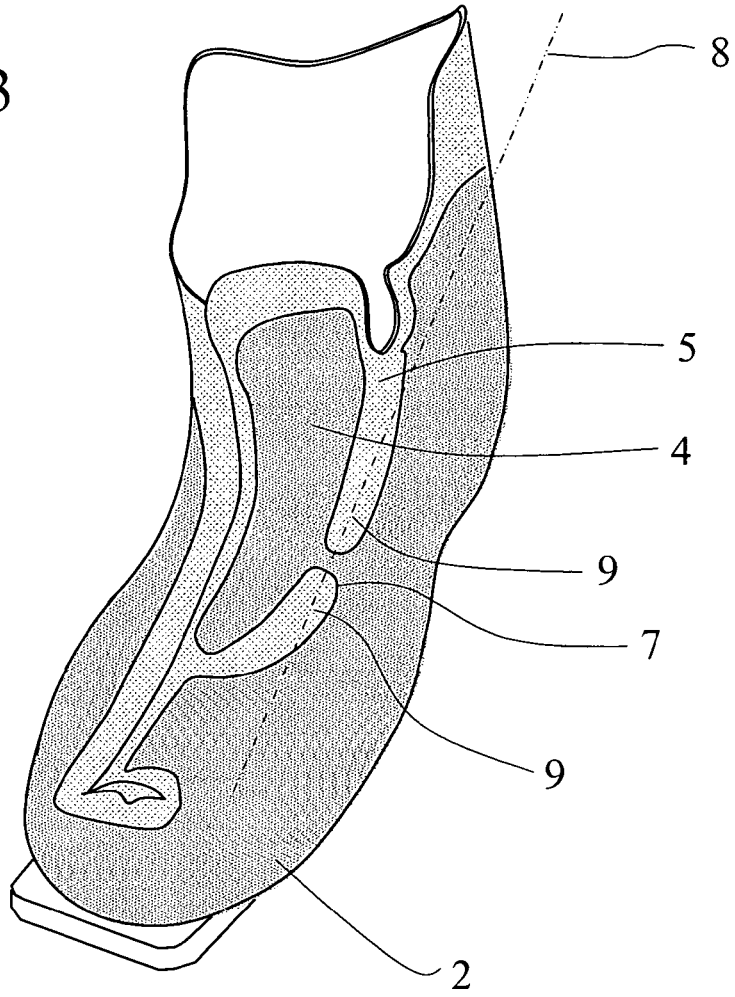
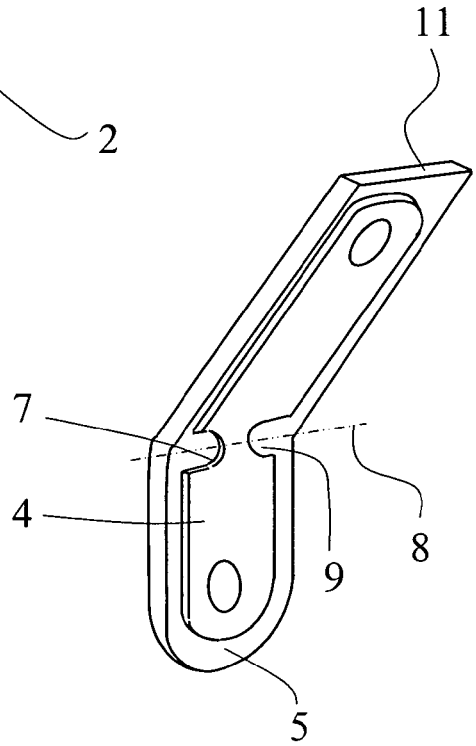
Fig.4

TWO-LAYER SPORTS BOOT PART WITH DEFORMATION ZONE

This application claims priority benefits from European Patent Application No. 05425031.1 filed Jan. 26, 2005.

BACKGROUND OF THE INVENTION

The invention relates to a sports boot part such as a lower-leg part, a shell or a strap, and to the sports boot itself and to the method for manufacturing it. It is particularly suited to boots for a board for gliding such as a ski or snowboard, or skating boots, which experience significant forces and are used in aggressive environments.

DESCRIPTION OF THE PRIOR ART

A ski boot, for example, requires, on the one hand, significant strength and, on the other hand, a high level of comfort. This is because a boot of this type experiences numerous stresses when it is used and consequently has to be very strong. A high degree of stiffness is also necessary in order to achieve good boot performance, since the boot, as the intermediate component between the skier and the ski, transmits the skier's effort to the ski in order to guide the latter. However, such a boot is also subject to significant constraints in terms of comfort. The boot must, in particular, have sufficient flexibility to enable the skier to open it in order to put it on and take it off, enable the skier to bend his knees forward in order to ski, and guarantee him sufficient comfort despite being used in extreme temperature conditions and in a wet, aggressive environment.

In order to satisfy these high-level conflicting constraints, a solution is described in patent WO 03001937, which is based on a lower leg part composed of at least two distinct parts, including a panel linked to the rest of the lower leg part by a hinge in order to allow the clearance of a sizeable opening, which greatly facilitates putting the boot on and taking it off the foot. With this solution, a stiff material may be used for the panel in order to achieve good levels of performance for the boot. This panel may also be manufactured from a different material as compared to the rest of the boot. A first drawback of this solution is that it requires the separate manufacture of several distinct parts of the lower leg part of the boot and then requires a complex mechanical step during which these parts are assembled. A second drawback of the solution is that it generates a risk of leakage at the hinge. A third drawback is that it is unattractive. Lastly, it is incompatible with today's multiple-injection manufacturing solutions.

A further solution is described in patent EP 0659358, which is based on a groove made over the entire length of a hard part of the shell in order to facilitate opening of the flap over the instep when the boot is put on or taken off. The drawback of this solution is that it complicates the manufacturing process since the groove has to be made over a significant length and requires a mold with a complex re-entrant angle, is unattractive and is incompatible with the multiple-injection solutions in use nowadays.

There is therefore a need for another solution in an attempt to satisfy the constraints of stiffness and comfort referred to above and, more particularly, to make it easier to put a boot on and take a boot off.

SUMMARY OF THE INVENTION

An object of the present invention consists in proposing a sports boot that does not present the drawbacks of the prior art.

More precisely, a first object of the present invention consists in proposing a sports boot that enables it to be put on and taken off easily while offering satisfactory stiffness and thus achieving good performance levels.

A second object of the invention consists in proposing a sports boot that is attractive to look at.

A third object of the present invention consists in proposing a sports boot for which the manufacturing method remains simple and compatible with multiple-injection processes.

According to the concept of the invention, a part of the sports boot comprises two superposed layers of plastics, one of which layers is present in a small amount on a deformation axis, by means of one or more recesses, in order to define a deformation zone of the part of the boot, this deformation having the function of making it easier to put the boot on and/or to take it off.

The invention is defined more precisely by the claims.

DESCRIPTION OF THE DRAWINGS

These objects, characteristics and advantages of the present invention will be set forth in detail in the following description of particular embodiments given by way of non-limiting example in connection with the attached figures, in which:

FIG. 3 shows a sports boot shell according to a second method of implementation of the invention;

FIG. 4 shows a strap according to a third method of implementation of the invention.

DESCRIPTION OF THE PREFERRED EMBODIMENTS

Figure 1:
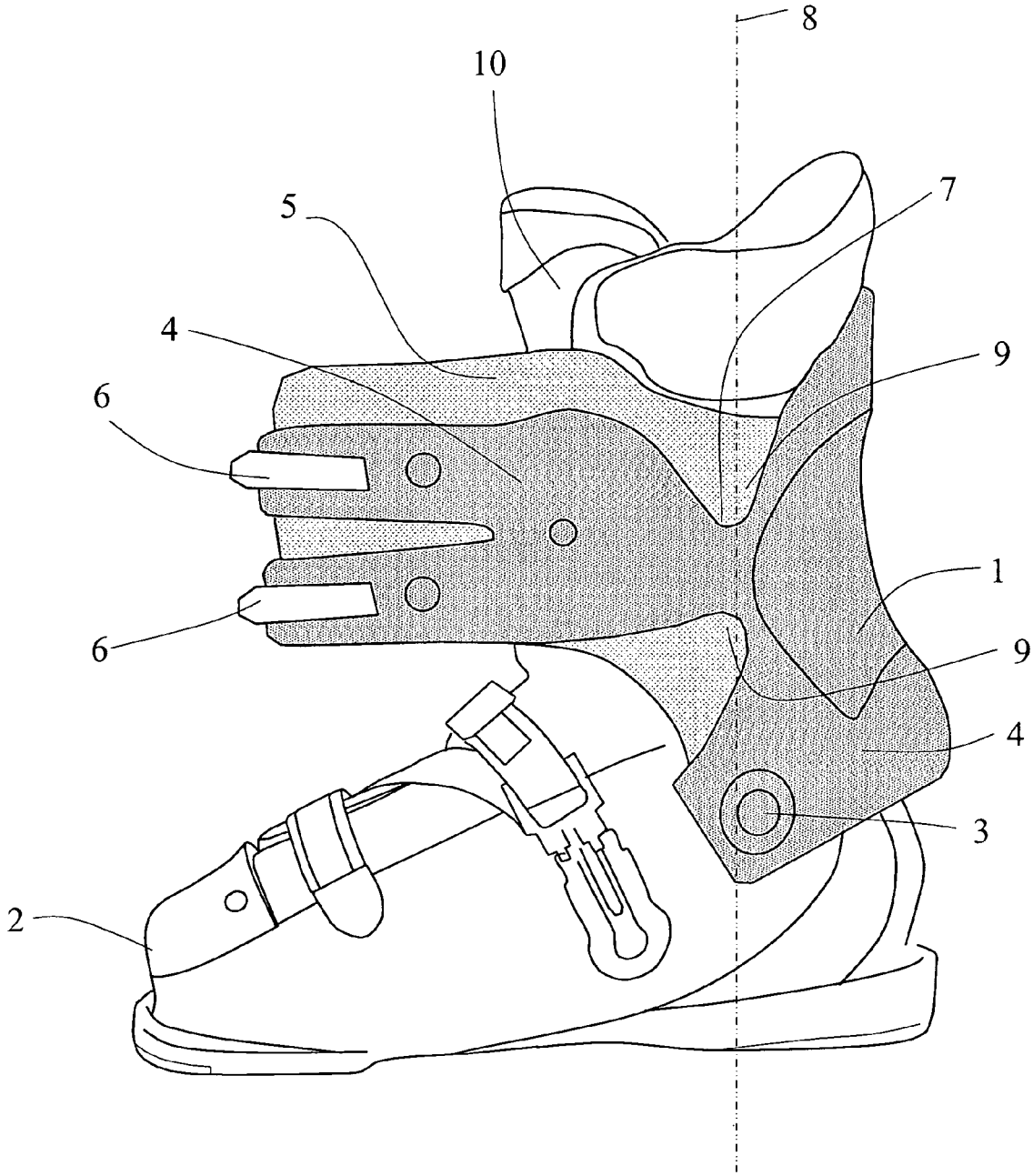
FIG. 1 shows a perspective view of a ski boot according to a first method of implementation of the invention.

According to a first method of implementation, illustrated in FIG. 1, a ski boot comprises a lower-leg part 1 forming a first embodiment of the invention. The lower-leg part 1 is mounted so as to be movable in rotation on a shell 2, about a transverse horizontal pin 3, the whole incorporating a liner 10. The lower-leg part 1 may thus turn slightly about this pin 3 in order to provide the required flexibility to the skier bending his knees while skiing. This lower-leg part 1 also comprises an opening on the front in order to make it easier to put the boot on, as is known in the prior art and attaching elements 6 on either side of the opening for closing the lower-leg part in order to ski. A part of the lower-leg part 1 comprises a stiff outer layer 4, for example made from polyurethane or from polypropylene having a Shore D hardness of 55, and a more flexible inner layer 5, for example made from polyurethane and/or from polypropylene having a Shore D hardness of 45. The outer layer 4 comprises a narrowing zone 7, produced by recesses 9 of the layer 4, which forms a substantially vertical lateral axis 8 along which the lower leg part comprises little stiff material. By way of example, the narrowing 7 consists of a height of approximately 3 centimeters of stiff material, representing approximately one third of the total height of the lower-leg part, the other two thirds thus comprising solely the more flexible material of the inner layer 5 of the lower-leg part, the height being understood to mean the measurement along a vertical axis, such as the axis 8.

According to this embodiment, the axis 8 is placed laterally but it could also, in a variant, be placed on the rear of the lower-leg part.

The combination between the two layers 4 and 5 of plastic makes it possible to define an optimum solution between the comfort sought and the overall stiffness of the lower-leg part that is required to achieve the boot's performance levels. The top part of the lower-leg part 1 which bears on the skier's shin comprises a narrow zone that comprises solely the more flexible, inner layer 5 in order not to injure the skier who exerts a high level of shin pressure in this zone while skiing. The stiff material of the lower-leg part of the outer layer 4, however, covers a globally significant height of the lower-leg part on the front of the leg in excess of 50% of this height except for the narrowing 7 described above, in order to allow good transmission of the skier's effort to the ski and thus to obtain good performance levels from the boot. This solution that combines two layers thus makes it possible to achieve a good compromise between comfort and stiffness for the boot.

Furthermore, the narrowing 7 makes it possible greatly to increase the possible deformation of the lower-leg part and its clearance by rotation about the axis 8 when the catching elements 6 are not closed, which makes it significantly easier to put the boot on and to take it off. This narrowing 7 concerns only a small part of the overall circumference of the lower-leg part and has no substantial impact on the stiffness of the lower leg part, and the boot's performance is unchanged. The inner layer 5 also guarantees that the lower-leg part is leaktight, particularly at the recesses 9 of the layer 4 lying on the axis 8.

According to a first embodiment, the ski boot described above may be manufactured using a twin-shot injection manufacturing method for the two layers of plastics in order to form the lower leg part. This widely used method has the advantage of speed and simplicity. It comprises a first stage of injecting the inner layer 5 and then a second stage of injecting the outer layer 4 over the top with the formation of the recesses 9 in order to form the narrowing 7.

According to a second embodiment, the ski boot described above may be manufactured by means of the injection of the outer layer 4 and the mechanical fixing or adhesive bonding or welding of the separately manufactured inner layer 5. This method makes it possible to be able to change the dimensions of the inner layer without having to produce an entire complex new lower-leg part mold.

Figure 2A:
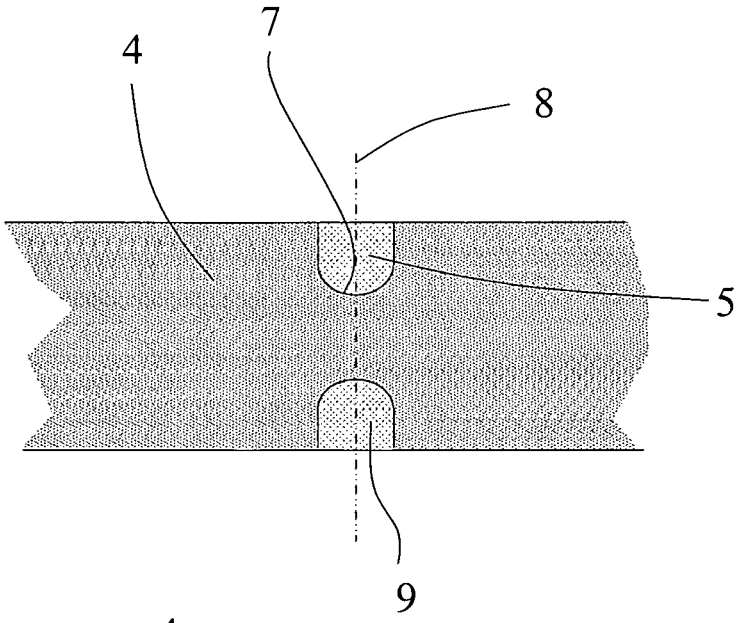
FIGS. 2*a* through 2*c* are diagrammatic illustrations of three embodiments of the invention.

FIG. 2*a* is a diagrammatic illustration of a first embodiment of the invention, which corresponds to that implemented on the ski boot described above, shown in FIG. 1, in which the recesses 9 are formed on the ends of the layer 4 in order to form a narrowing 7 of said layer 4.

Figure 2B:
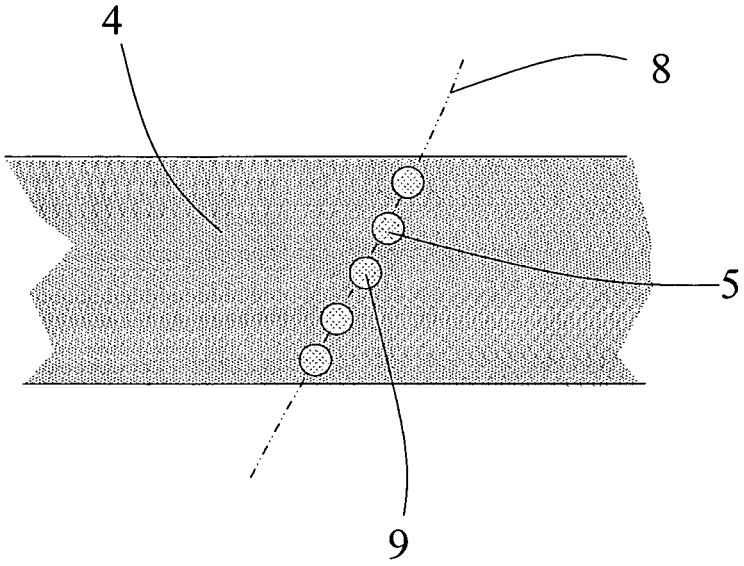

FIG. 2*b* illustrates a second embodiment of the invention, in which the axis 8 is oblique, by way of example, and in which the layer 4 comprises a plurality of small recesses 9, revealing the inner layer 5.

Figure 2C:
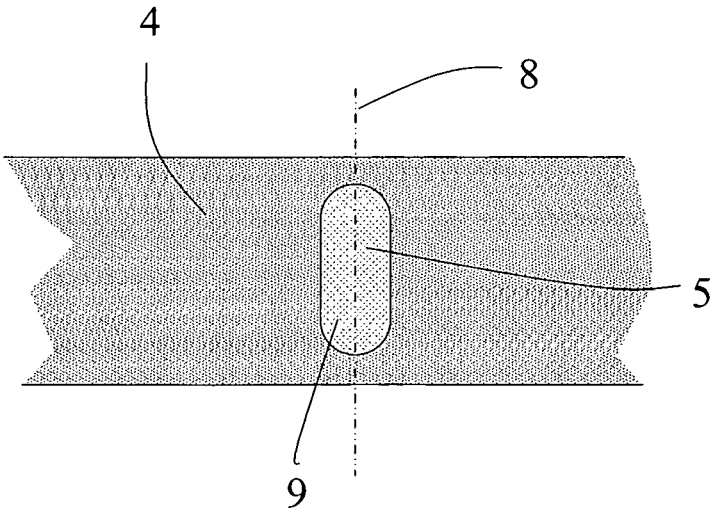

FIG. 2*c* illustrates a third embodiment, which comprises a wide recess 9 centered on the height of the lower-leg part, which defines an oblong opening in the outer layer 4.

According to variants, not shown, the recess or recesses might not pass right through the outer layer 4. Moreover, the order of the two layers could be reversed, the inner layer comprising the recess or recesses in order to form the axis of rotation 8. Said axis may lie in any direction that enables a part of the boot to be moved away in order to make it easier to put the boot on and to take it off. The solution may be implemented solely over the circumference of the boot concerned by the requirement for opening for putting the boot on, the other part of the circumference, for example the rear, remaining conventional. Both the two layers may also comprise recesses distributed in such a manner to preserve the leaktightness of the boot, for example by their not being superposed. Lastly, the two layers may have hardnesses that are different from the example illustrated above, without departing from the scope of the invention, since the overall hardness of the lower-leg part is substantially reduced along an axis 8 in order to allow its deformation along this axis.

The concept of the invention as presented above may be implemented on any part of the sports boot, the manufacturing method also being suitable for any part.

FIG. 3 illustrates a second example of implementation of the invention on the shell 2 of a sports boot, more precisely on a part of the shell forming a flap over an opening of the shell positioned at the instep. This flap is formed from two superposed layers, the outer layer 4 comprising recesses 9 forming a narrowing 7 of this layer on an axis 8 that defines a deformation axis. The flap thus acquires a greatly enhanced possibility of clearing the instep zone of the shell, thereby enlarging the opening and making it easier to put the boot on and take it off.

FIG. 4 illustrates a third example of implementation of the invention, on a sports boot strap 11. In this case, such a strap may, for example be used for closing and tightening the sports boot, by means of being superposed over the openings of the lower-leg part 1 and/or of the shell 2 mentioned above. In order to make it easier to put the boot on and to take it off, it is also advantageous to be able to move this strap out of the way as far as possible in order to be able to maximize opening of the boot when it is put on and taken off. According to the concept of the invention, a strap of this type is composed of two layers of materials, the layer 4 having the recesses 9 in order to form an axis of rotation 8.

The strap may be manufactured such that when the boot is open, it presents an angle about the axis 8 that clears it from the opening of the boot and thus naturally, in the rest position, makes it easier to put the boot on and to take it off. In order to close the boot, the user grasps the strap, turns it about the axis 8 in order to superpose it over the opening to be closed, before actuating the customary closure means. Similarly, in the above implementations, the lower-leg part and/or the shell of the boot may have a part whose position at rest presents an angle about an axis 8 vis-à-vis the rest of the boot in order to create an enlarged opening of the boot, which makes it easier to put the boot on and to take it off.

In a variant of the latter implementation, the concept of the invention may be extended to straps placed on certain boot bindings on a board for gliding, which bindings sometimes comprise certain of the functions of the sports boot mentioned above. For example, certain snowboard bindings comprise a part in the form of a boot shell, fastened to the snowboard, comprising closure straps, into which a relatively soft boot is placed, which is closed and tightened by said straps. In such a case, the straps for closing and tightening the boot have been moved on to the board for gliding. However, the overall concept of the invention remains the same since it is always necessary to facilitate positioning of the foot on the board for gliding. Thus, the invention applies also to all or part of a boot fixed on a gliding device, such as a skate, snowboard, or the like.

The concept of the invention also offers further possibilities in terms of the esthetic appearance of the boot. Indeed, it is possible, for example to use at least one translucent or transparent layer positioned, for example, on the layer with recesses, in order to reveal these recesses while still protecting them. In such a case, an impression, mark or any intermediate support arranged between the two layers, may make it possible to make the recesses more easily seen. According to another example, the material of the inner layer, if it is more flexible and of different appearance may also occupy the volume of the recesses of the stiffer upper layer and thus create an attractive esthetic effect.

Lastly, the solution satisfactorily achieves the objects sought and offers the following advantages:

- a part of the sports boot, such as a lower-leg part, a shell or a strap, can make it possible greatly to facilitate putting the boot on and taking it off and thus the comfort of the boot while still preserving significant overall stiffness;
- the combination of the two layers, which may have different mechanical properties and appearances, makes it possible to increase the boot's comfort, offers attractive esthetic possibilities and guarantees leaktightness;
- the solution may be easily obtained using the widely used multiple-injection manufacturing methods, while still remaining compatible with older methods.

The invention claimed is:

1. A sports boot lower-leg part comprising a part comprising at least two superposed injected layers of plastics at least partially surrounding the lower leg and comprising an opening that can be closed by catching means (6) distributed on either side of this opening, wherein one (4) of the two layers has one or more recesses (9) lying on an axis (8) in order to define a deformation axis of the lower-leg part, allowing that part of the lower-leg part that is around this axis (8) to move away in order to enlarge the opening and make it easier to put the boot on and to take it off, wherein material of the one or more layers not having the recess is more flexible and occupies at least partially the volume of one or more recesses (9) of the layer (4) having the one or more recesses.

2. The sports boot lower-leg part as claimed in claim 1, wherein the deformation axis is substantially vertical.

3. The sports boot lower-leg part as claimed in claim 1, wherein the axis (8) is placed laterally.

4. The sports boot lower-leg part as claimed in claim 1, wherein the axis (8) is placed at the rear of the lower-leg part.

5. A sports boot comprising a lower-leg part as claimed in claim 1.

6. The sports boot as claimed in claim 5, wherein a layer (4) comprises recesses (9) formed on its ends in order to form a narrowing (7) of this layer (4).

7. The sports boot as claimed in claim 5, wherein a layer (4) comprises at least one recess (9) forming an opening within the layer (4).

8. The sports boot as claimed in claim 7, wherein the recess (9) is a wide, substantially central opening of oblong shape.

9. The sports boot as claimed in claim 7, wherein a layer (4) comprises a plurality of small recesses (9) that are substantially in line.

10. The sports boot as claimed in claim 5, which comprises a rigid layer (4) comprising at least one recess (9) and another, more flexible layer (5).

11. The sports boot as claimed in claim 5, which comprises at least one transparent or translucent layer.

12. The sports boot as claimed in claim 11, which comprises an impression between the two layers in order visually to reveal the recesses (9).

13. The sports boot lower-leg part as claimed in claim 1, wherein the one or more recesses (9) do not pass right though the layer (4) having the one or more recesses.

14. The sports boot lower-leg part as claimed in claim 13, wherein material of the one or more layers not having the recesses is more flexible and of different appearance and occupies volume of one or more recesses (9) of the layer (4) having the recesses and thus creates an attractive aesthetic effect.

15. The sports boot lower-leg part as claimed in claim 1, wherein the layer (4) having one or more recesses comprises recesses (9) formed on each of its ends in order to form a narrowing (7) of this layer (4).

16. The sports boot lower-leg part as claimed in claim 15, wherein the layer (4) having one or more recesses comprising a stiff layer, presenting a rear upper end above its front upper point, and wherein the second layer is a more flexible layer.

* * * * *